United States Patent [19]

Martinez et al.

[11] Patent Number: 4,489,815

[45] Date of Patent: Dec. 25, 1984

[54] PICNIC BAG AND MAT

[76] Inventors: Isidro A. Martinez, 4330 NW. 196th St., Coral City, Fla. 33055; Beatriz Gutierrez, 3100 SW. 67th Way, Miramar, Fla. 33023

[21] Appl. No.: 502,759

[22] Filed: Jun. 9, 1983

[51] Int. Cl.[3] ..... A45C 7/00; A45C 9/00; A45C 11/20; B65D 5/36

[52] U.S. Cl. ..... 190/1; 190/2; 190/107; 5/417; 229/41 B; 229/50; 383/4

[58] Field of Search ..... 229/16 R, 16 A, 41 B, 229/50; 190/1, 2, 8, 107; 383/4; 5/417, 419, 420

[56] References Cited

U.S. PATENT DOCUMENTS

| | | | |
|---|---|---|---|
| 621,824 | 3/1899 | Kleeman | 229/41 B |
| 664,835 | 1/1901 | Czarniecki | 229/41 B X |
| 687,704 | 11/1901 | Unser | 229/41 B X |
| 751,190 | 2/1904 | Martin | 190/2 |
| 888,653 | 5/1908 | Potter | 229/41 B X |
| 1,495,669 | 5/1924 | Burkholder | 229/41 B X |
| 1,760,325 | 5/1930 | Small | 229/50 X |
| 2,584,432 | 2/1952 | De Marco | 190/1 X |
| 3,904,106 | 9/1975 | Elder | 229/41 B X |
| 3,976,113 | 8/1976 | Kim | 383/4 |
| 4,034,909 | 7/1977 | Toda | 229/41 B |
| 4,188,988 | 2/1980 | Agyagos | 190/2 X |
| 4,197,891 | 4/1980 | Comollo | 190/2 X |

FOREIGN PATENT DOCUMENTS

| | | | |
|---|---|---|---|
| 808759 | 7/1951 | Fed. Rep. of Germany | 383/4 |
| 1532853 | 12/1969 | Fed. Rep. of Germany | 383/106 |
| 148132 | 12/1954 | Sweden | 229/41 B |
| 1407484 | 9/1975 | United Kingdom | 190/2 |
| 2054388 | 2/1981 | United Kingdom | 190/1 |

*Primary Examiner*—William Price
*Assistant Examiner*—Sue A. Weaver
*Attorney, Agent, or Firm*—Jesûs Sanchelima

[57] ABSTRACT

This invention relates to dual purpose tote bags in which one purpose is to provide a carrying bag or box and the other is to provide for a semi-rigid surface, which can be used for carrying and, holding food and for providing a table-like surface during picnics and outings. Prior devices have never fully satisfied the second purpose, their surfaces being too soft and pliable, this leading to problems in fulfilling the first purpose also in that the bag would not provide a semi-rigid internal space for carrying a payload. This invention teaches a new construction and a new method for converting from one purpose to the other.

The new construction is both internal; employing three layers, the center layer being of semi-rigid material and, external; in the arrangement of the panels of the three-layered material.

The new method of folding employs a stepwise folding of the flat panels into a box-like shape, suitable for maintaining a semi-rigid internal space. In its preferred form it is held together at strategic points in its box-form with "Velcro" fasteners and is also provided with straps for carrying and reinforcement.

4 Claims, 6 Drawing Figures

PICNIC BAG AND MAT

BACKGROUND OF THE INVENTION

1. Field of the Invention

This invention relates to the field of multipurpose tote bags and picnic mat combinations.

2. Description of the Prior Art

A number of devices have been patented which provide for a bag/blanket combination, for example, those described in U.S. Pat. Nos. 4,197,891 and 4,188,988 and that described in the British Pat. No. 1,407,484, which provides for a towel/pillow/bag combination. However, the invention herein has never been described. The prior devices do not have the ability to maintain a rigid internal space and hence, anything carried within them is subject to unequal squeezing pressures, making the carrying of prepared or semi-prepared foodstuffs difficult. Prior devices were also of limited usefulness for small groups of people since they were unable to hold the kind or amount of food stuffs or other items containable by the present invention. Also, when set out on uneven surfaces, no leveling effect could be attributed to prior devices, although one is provided by this device. In short, the prior devices contained neither the storage space nor the rigidity provided by this device.

Other patents describing the closest subject matter provide for a number of more or less complicated features that fail to solve the problem in an efficient and economical way. None of these patents suggest the novel features of the present invention.

SUMMARY OF THE INVENTION

The main object of this invention is to provide volumetricly efficient picnic type bag and mat combination of structural integrity.

Another object of this invention is to provide such a bag which is light to carry and easily assembles and de-assembles to transform from one form as a tote to its alternate form as a mat.

Another object of this invention is to provide for such a bag which unfolds leaving the contents relatively undisturbed by the process of unfolding.

Yet another object of this invention is to provide such a bag which maintains a relatively rigid internal space during transportation.

Still another object of this invention is to provide such a bag which when set out on an uneven surface will provide a leveled areas.

Further objects of the invention will be brought out in the following part of the specification, wherein the detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
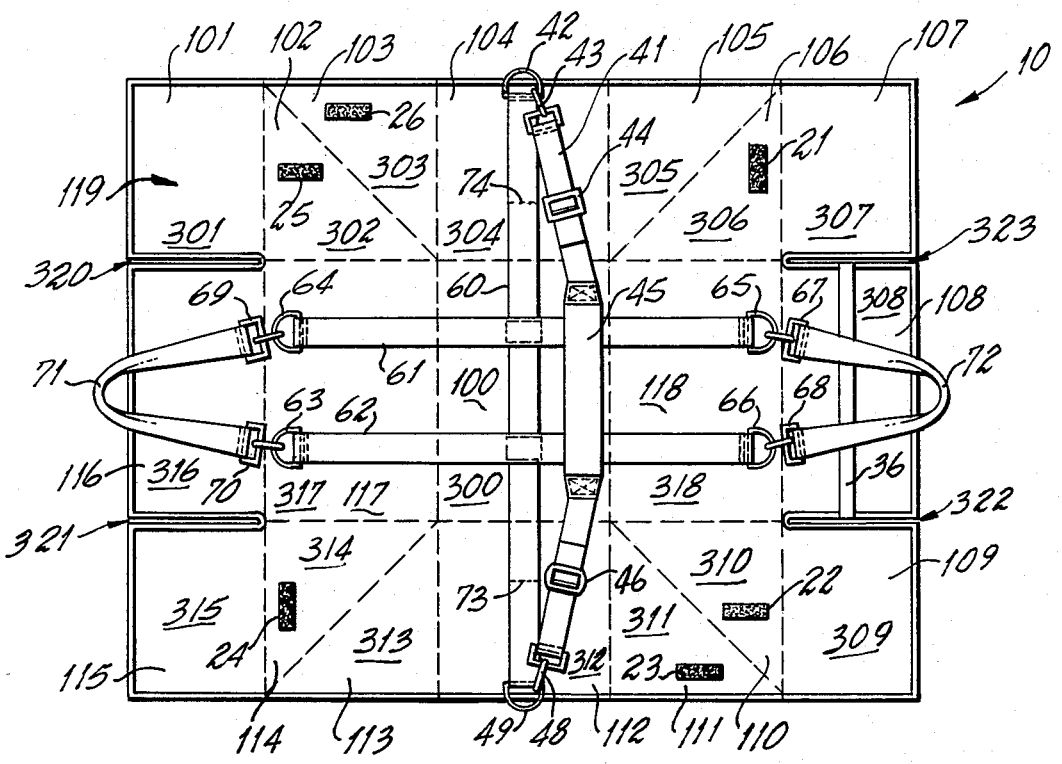
FIG. 1 is an overview of the underside of the preferred embodiment.
Figure 2:
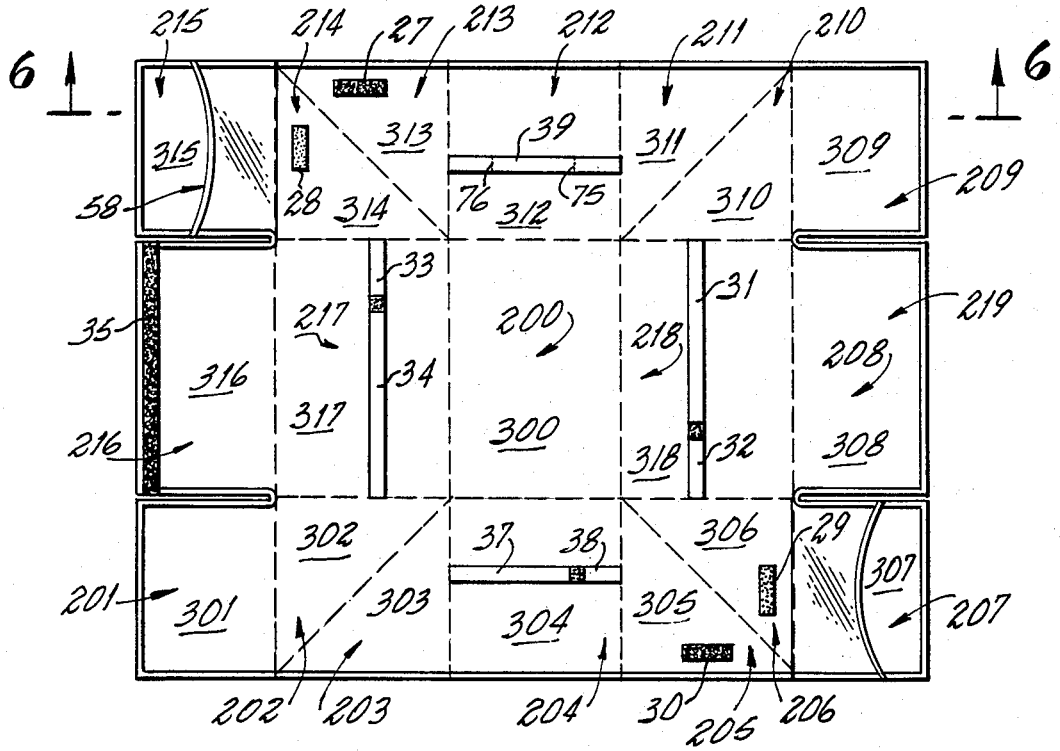
FIG. 2 is an overview of the overside of the invention.

The preferred embodiment is referred to generally in FIG. 1 with the numeral 10. It is generally comprised of interconnected panels 300 through 318, which are joined by linear joints at at least one end so as to form a flat pad or mat; substantially as shown in FIG. 2, when unfolded into a plane. When folded as described within, the invention is held by its own shape and by fasteners 19 through 37 (denominated "Velcro strips", "Velcro pads" and "loose Velcro strips" within). These fasteners are preferrably of the type known by the tradename "Velcro", which are composed generally of a pair of plastic pads or strips which adhere to each other by virtue of hooks and barbs extending from the surfaces of each and which grasp each other releasably when the two surfaces are brought to contact each other. The invention may be color coded or numerically coded for ease of folding.

It is believed that the invention is most useful with the arrangements of straps 60, 61 and 62, handle straps, 71 and 72, and padded carrying strap 41 as drawn, although other arrangements could be used which provide similar support and carry ability functions.

Referring back to FIG. 1, the invention 10 is seen spread face-down with the underside faces 100 through 118 visible as the upper surfaces of panel members 300 through 318 in corresponding numerical order. Panels 300 through 318 are denominated more specifically as follows. Panel 300 is bottom rectangular panel located centrally and joined along each edge to front square panel 304 and rear square panel 312, at the top and bottom, respectively and to a pair of lateral panels 317 and 318 along the left and right edges respectively. Triangular panels 302, 303, 305, 306, 310, 311, 313 and 314 are arranged to form four squares whose corners touch the corners of bottom, rectangular panel 300 and whose edges adjacent to said corners are foldably joined at the edges of rear square panel 312, front square panel 304 and lateral panels 317 and 318 as shown. Top panels 308 and 316 are foldably joined to edges of lateral panels 318 and 317, respectively. In the preferred embodiment the four squares corner panels 301, 307, 309 and 315 form just that, a square. However, they may be any shape which can be folded under the top panels 316 and 308 (or even over them if they join or are fastened to one of the top panels 316 or 308). The reason a square shape is preferred is that it provides for a uniform looking mat when unfolded. Reinforcing strap 60 cuts across center underside face 100 and underside faces 112 and 104, said strap being composed of a nylon woven fiber and connected to said underside faces by sewing or glueing between seams 74 and 73 and thence being free from those seams to rings 42 and 49. Clip and eye 43 releasably connect one end of padded carrying strap 41 to strap 60 through ring 42 and clip and eye 48 releasably connect strap 41 to reinforcing strap 60 through ring 49. Sewn over strap 60 is pad 45 and strap 60's length is adjustable through the operation of adjustment buckles 44 and 46. Reinforcing straps 61 and 62 are substantially perpendicular to partially reinforcing strap 60 and connected along their entire lengths to underside faces 117, 100 and 118. Both reinforcing straps 61 and 62 have rings 63, 64, 65 and 66 at each end for connection to clips and eyes 67, 68, 69 and 70 at the ends of carrying strap handles 71 and 72. In the preferred embodiment these straps 61 and 62 are of nylon and all the clips and eyes 43, 48, 69, 70, 71 and 72 are of a very strong plastic.

The rings 42, 49, 63, 64, 65 and 66 are all of stainless steel. Construction from these materials promotes long life and reliable service as well as minimal maintenance.

On the underside surface 119 several other features are visible as well, including the Velcro pads 21, 22, 23, 24, 25, 26 and 36. The dotted lines indicate generally the foldable joined edges between adjacent panels and slots 320, 321, 322 and 323 are also clearly defined in this FIG. 1. Said Velcro pads 21, 22, 23, 24, 25, 26 and 36 are sewn or glued to underside faces 106, 110, 111, 114, 102, 103 and 108, respectively. Similarly to the underside surface 119, the overside surface 219's faces 200 through 218 correspond with their numerically equivalent counterpart panels 300 through 318 as shown. Pockets 57 and 58, interior loose Velcro strips 31 and 32, 33 and 34, 37 and 38, and elastic band 39 with seams 75 and 76 are not essential features of the invention but do provide for ease of use because they may be easily employed to support items, for example, a ketchup bottle, a mustard bottle and a wine bottle to be carried within with no risk of them smashing against each other during rough and bumpy portage. Other similar arrangements might be made within the inventive concept detailed herein.

Velcro pads 27, 28, 29, 30 and 35 are structurally important features, the function of which is described below.

Figure 3:
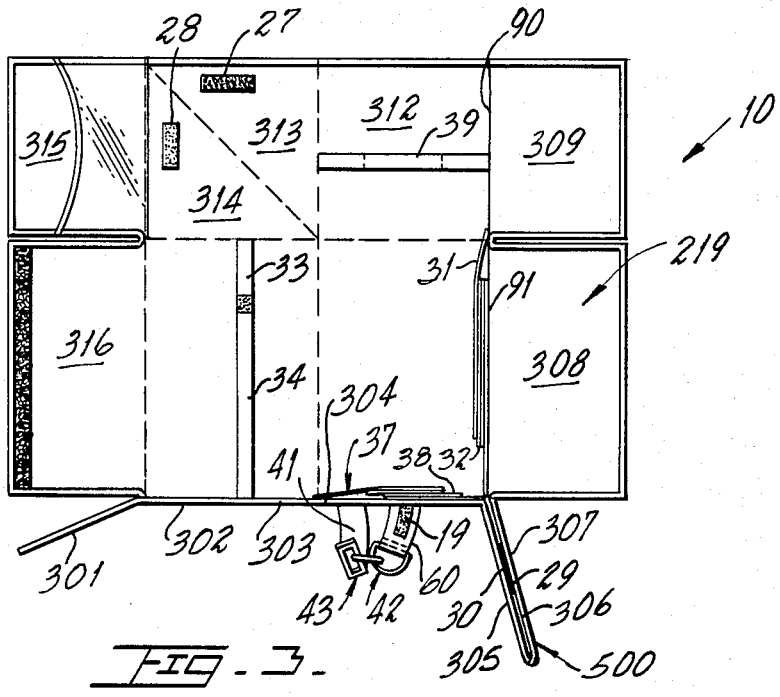
FIG. 3 is an overview of the first stage in folding the invention.

Refer now to FIGS. 2 and 3 for a description of the begining of the folding process through which this mat becomes a bag, basket, box, or carry all (hereinafter denominated bag). In FIG. 3, as in FIG. 2, the overside surface 219 is facing the observer. In FIG. 3, panels 301, 302, 303, 304, 305, 306 and 307 are first folded upward toward the observer thence panels 305 and 306 are folded together and joined at Velcro pads 29 and 30, bringing panels 311 and 310 and 318 into an upright position, becoming lines 90 and 91, respectively, to the observer. Panels 309 and 308 remain flat and visible when folded back as shown to aid in visualization.

Note that strap 60 has a Velcro pad 19 attached for adhesion to underside surface panel 102's Velcro pad 25 when the bag is assembled. A Velcro pad (not shown), is attached to an identical position on the opposite end of strap 60, below seam 73 (FIG. 1), for attachment to Velcro pad 22 in the assembled bag. Loose Velcro strips 37 and 38, 31 and 32, are shown in sideview.

Figure 4:
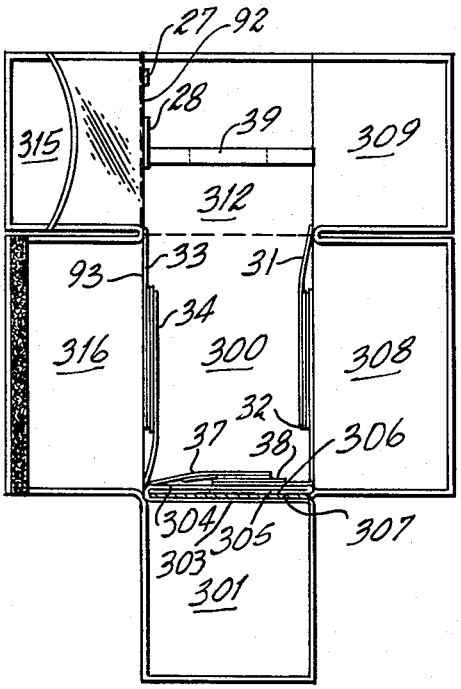
FIG. 4 is an overview of a later stage in folding the device.

Referring now to FIG. 4, the panel 307 is removed and part of 306 is cutaway and visible as the lined segment toward the Figure's bottom.

To proceede from FIG. 3 to FIG. 4, the following steps occur.

1. The flap comprising panels 305, 306 and 307, at the bottom of FIG. 3, is folded below panel 304.

2. Panels 302 and 303 are brought together with their oversides 202 and 203 together. This brings "up" panels 313, 314 and 317 and panels 315 and 316 are allowed to fold downward to be visible to the observer. Lines 92 and 93 represent the folds beneath which panels 314 and 313, and 317 stand, respectively.

3. Panels 302, 303 and 301 are then folded to join Velcro pads 21 of panel 306 and 26 of panel 303.

4. Panel 307, which is here removed for visibility, would then be folded back with panel 301, as panel 301 is shown.

Figure 5:
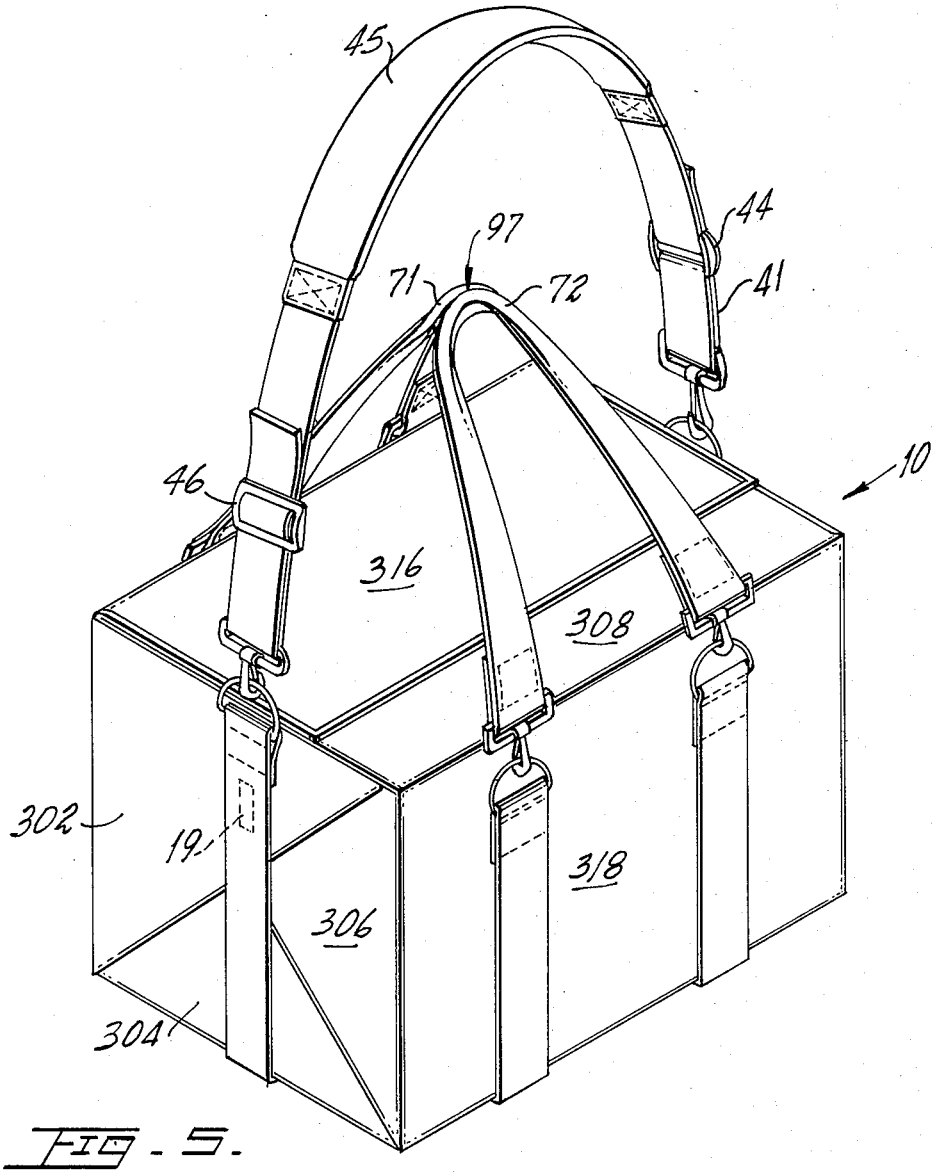
FIG. 5 is a view perspective of the folded device.

To proceed from FIG. 4 to FIG. 5, the following steps are followed:

5. Panels 311 and 310 are folded with their overside faces 111 and 110 together.

6. Velcro pads 27 and 28 on overside faces 114 and 113 are allowed to join.

7. A flap comprising panels 313, 314 and 315 is folded against the underside face 212 of panel 312.

8. A flap comprising panels 311, 310 and 309 is folded against the flap of the preceeding step, allowing Velcro pads 23 and 24 to fasten together.

At this juncture the bag is an open box shape most suitable for loading, which, it is contemplated, will be done before proceeding further.

9. Panels 309, 315, 301 and 307 are folded inwardly, thence panel 308 is folded over these.

10. Panel 316 is folded over panel 308 and Velcro strips 35 and 36 "seal" the bag when joined.

A pair of Velcro strips or other type of fastener may be added to the junction 97 of carrying strap handles 71 and 72, for ease of handling.

Figure 6:
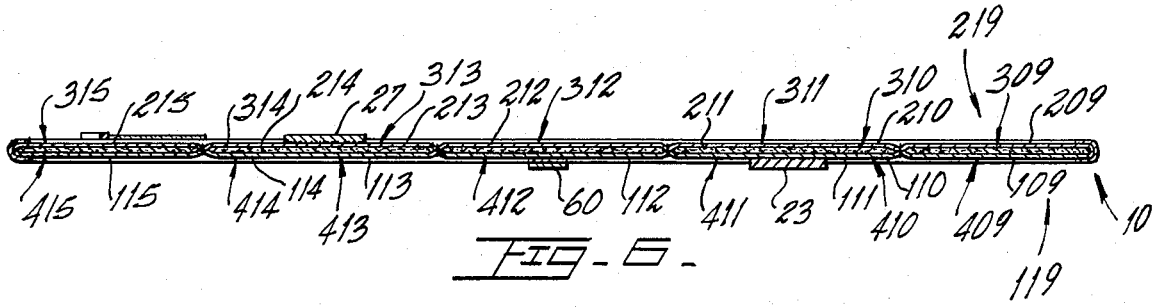
FIG. 6 is a cross-sectional view of the device taken at line 6—6 of FIG. 2.

Referring now to FIG. 6, a cross-sectional view of the invention 10 is shown detailing the interior of panels 309, 310, 311, 312, 313, 314 and 315. Chipboard panels 409, 410, 411, 412, 413, 414 and 415 form the structural support for these numerically corresponding panels and are made from chipboard, also called card board which is known in the trade as 0.050 bag fiber chipboard. Approximations of this maybe used which provide for similar bending qualities such as some resilient plastics or other fiber boards. The essential qualities required are a fair degree of rigidity and a small likelihood of cracking or breaking over a wide range of temperatures and handling situations.

Ideally, it should provide some insulation as well, for it is comtemplated that the bag's cargo will often be better preserved at certain temperatures.

It is believed the foregoing description conveys the best understanding of the objects and advantages of the present invention. Different embodiments may be made of the inventive concept of this invention. It is to be understood that all matter disclosed herein is to interpreted merely as illustrative, and not in a limiting sense, except as set forth in the following appended claims.

What is claimed is:

1. A mat comprising, in operative combination:

a. a rectangular bottom panel having a front, a rear and two lateral edges;

b. a pair of square end panels joined to said front and rear edges;

c. a pair of rectangular lateral panels, having the same dimensions of said rectangular bottom panel, each joined along one of its long edges to said lateral edges;

d. a pair of rectangular top panels, having substantially the same dimensions of said rectangular bottom panel, each joined along one of its long edges to the other long edge of each of said rectangular lateral panel;

e. four pairs of triangular panels, wherein each pair forms a square that is joined to one of said square end panels on one side and to the shortest edge of one said lateral panels on the other side so that each triangular pair is positioned on each of the corners of said rectangular bottom panel;

f. four flat corner panels adjacent at one edge to one of the shortest edges of said rectangular top panels and the other edge adjacent to one of the edges of an adjoining triangular panel and said corner panels positioned so that a large substantially square mat configuration is completed; all of said panels are comprised of a semi-rigid material and wherein said panels have an underside and overside surface;

g. a plurality of Velcro fastener means mounted, in complementary sets, on the overside surfaces of two pairs of triangular panels which are at opposite corners of said bottom rectangular panels, on the overside of one of said top panels, on the underside surface of the other set of two pairs of said triangular panels which are at the opposite corners of said bottom rectangular panel, on the underside surfaces of the one of each of said other set of two pairs of said triangular panels which is joined to said lateral panels, and on the underside of the other said top panels and adapted to hold said device in a box-shape when folded.

2. The device set forth in claim 1 further comprises a pair of first reinforcing straps extending parallely across said bottom rectangular panel and said pairs of lateral panels, each of said straps ending in a ring on both ends, a second reinforcing strap extending centrally across said square end panels and said rectangular bottom panel which is perpendicular to said pair of reinforcing straps and ending at both ends in rings, a padded, adjustable carrying strap having a clip on both ends for attachment to said rings of said seconds reinforcing strap and having adjustment means and padding means and a pair of carrying-straps having a clip on both ends for attachment to said rings of said second reinforcing strap and having adjustment means and padding means.

3. The device set forth in claim 2 wherein said device further comprises internal retaining straps for holding a payload within the tote bag.

4. The device set forth in claim 3 wherein said device comprises internal pockets.

* * * * *